US009841247B2

(12) United States Patent
Nilsson et al.

(10) Patent No.: US 9,841,247 B2
(45) Date of Patent: Dec. 12, 2017

(54) MANAGEMENT SYSTEM AND METHOD FOR SORTING MIXED AMMUNITION TYPES

(71) Applicant: BAE SYSTEMS BOFORS AB, Karlskoga (SE)

(72) Inventors: Andreas Nilsson, Karlskoga (SE); Per Trulsson, Vänersborg (SE); Ulf Palmlöv, Degerfors (SE)

(73) Assignee: BAE SYSTEMS BOFORS AB, Kariskoga (SE)

( * ) Notice: Subject to any disclaimer, the term of this patent is extended or adjusted under 35 U.S.C. 154(b) by 44 days.

(21) Appl. No.: 15/101,180

(22) PCT Filed: Nov. 3, 2014

(86) PCT No.: PCT/SE2014/000130

§ 371 (c)(1),
(2) Date: Jun. 2, 2016

(87) PCT Pub. No.: WO2015/069167

PCT Pub. Date: May 14, 2015

(65) Prior Publication Data

US 2016/0370136 A1 Dec. 22, 2016

(30) Foreign Application Priority Data

Nov. 7, 2013 (SE) ..... 1300692

(51) Int. Cl.
*F41A 9/37* (2006.01)
*F41A 9/76* (2006.01)
*F41A 9/04* (2006.01)

(52) U.S. Cl.
CPC *F41A 9/37* (2013.01); *F41A 9/04* (2013.01); *F41A 9/76* (2013.01)

(58) Field of Classification Search
CPC ..... F41A 9/37; F41A 9/01; F41A 9/00; F41A 9/38; F41A 9/82; F41A 9/76; F41A 9/04
(Continued)

(56) References Cited

U.S. PATENT DOCUMENTS 2,933,981 A * 4/1960 Anderson ..... F41A 9/04 89/1.804
3,376,785 A * 4/1968 Elwin ..... F41A 9/05 89/1.1

(Continued)

FOREIGN PATENT DOCUMENTS

DE 19505349 A1 8/1996
WO WO-2004/025209 A1 3/2004

(Continued)

OTHER PUBLICATIONS

PCT/ISA/210—International Search Report—Feb. 13, 2015 (Issued in Application No. PCT/SE2014/000130).

(Continued)

*Primary Examiner* — Jonathan C Weber
(74) *Attorney, Agent, or Firm* — Venable LLP; Jeffri A. Kaminski

(57) ABSTRACT

An ammunition management system for firing mixed ammunition in an automatic cannon. The ammunition management system includes a rotatable ammunition magazine including ammunition shot, a breech casing and an ammunition feed device for feeding of ammunition shot between the ammunition magazine and the breech casing. A drive device drives the ammunition magazine via a chain drive mechanism disposed in the ammunition magazine. A decoupling device engages and disengages the ammunition magazine with respect to the ammunition feed device, so that ammunition can be moved between different positions in the ammunition magazine, via an alternating process including: feeding of ammunition from the ammunition magazine to (Continued)

the ammunition feed device, disengagement of the ammunition magazine, rotation of the ammunition magazine, engagement of the ammunition magazine, and feedback of ammunition from the ammunition feed device to the ammunition magazine. A method for sorting ammunition in a ammunition magazine.

8 Claims, 6 Drawing Sheets

(58) Field of Classification Search
USPC ..... 89/45–47, 33.01–33.05, 33.1, 33.14, 89/33.16, 33.17
See application file for complete search history.

(56) References Cited

U.S. PATENT DOCUMENTS 3,683,743 A * 8/1972 Stoner ..... F41A 9/37 89/135
4,434,700 A * 3/1984 Aloi ..... B65G 47/248 198/370.01
4,450,750 A 5/1984 Gillum
4,535,677 A * 8/1985 Panhke ..... F41A 9/62 89/34
5,177,318 A * 1/1993 Martinez ..... F41A 9/50 89/33.04
5,233,125 A * 8/1993 Bouver ..... F41A 9/50 89/34
5,245,906 A * 9/1993 Muller ..... F41A 9/04 89/33.04
5,271,310 A * 12/1993 Muller ..... F41A 9/04 89/33.04
6,119,576 A * 9/2000 Isachsen ..... F42B 35/00 89/41.03
6,272,967 B1 8/2001 Bender-Zanoni et al.
8,549,978 B2 * 10/2013 Chiappini ..... F41A 9/26 89/1.805
2011/0258898 A1 * 10/2011 Chiappini ..... F41A 9/26 42/6
2013/0205980 A1 * 8/2013 Simon ..... F41A 9/37 89/27.12
2016/0231074 A1 * 8/2016 McDaniel ..... F41A 9/54

FOREIGN PATENT DOCUMENTS

WO WO-2009/049710 A1 4/2009
WO WO-2009/049721 A1 4/2009

OTHER PUBLICATIONS

PCT/ISA/237—Written Opinion of the International Searching Authority—Feb. 13, 2015 (Issued in Application No. PCT/SE2014/000130).

* cited by examiner

MANAGEMENT SYSTEM AND METHOD FOR SORTING MIXED AMMUNITION TYPES

CROSS-REFERENCE TO RELATED APPLICATIONS

The application claims priority to Swedish patent application 1300692-9 filed 7 Nov. 2013 is the national phase under 35 U.S.C. §371 of PCT/SE2014/000130 filed 3 Nov. 2014.

FIELD OF THE INVENTION

The present invention relates to an ammunition management system and to a method for sorting and firing mixed ammunition types in an automatic cannon. Included ammunition types can differ in number and type.

For present-day ammunition management systems there is a requirement for sorting and firing of mixed ammunition types to proceed quickly, especially in the firing of shots in which shots which are fired in periods following preceding shots are expected to hit the target substantially simultaneously with the previously fired shot or shots.

BACKGROUND OF THE INVENTION

Ammunition management systems of the kind stated in the introduction, for firing mixed ammunition types in an automatic cannon, are previously commonly known. Examples of such ammunition management systems are described in documents: WO 2009/049710 A1, WO 2009/049721 A1 and WO 2004025209 A1. In the stated documents, devices and methods based on sensor-based functions for feeding different types of ammunition shot (M1, M2, M3) from a plurality of different magazines via a plurality of different chains (Z1-Z3) to an automatic cannon via a common rotor 2 are described, see, for example WO 2009/049721 A1, FIG. 2, abstract and description on page 4.

A problem with the said ammunition management systems is the use of a plurality of ammunition magazines and a plurality of feed chains, which makes the systems complex and increases the risk of malfunction, thereby resulting in fire stoppages.

The object of the present is to solve, inter alia, these problems.

SUMMARY OF THE INVENTION

A principal object of the present invention has been to provide a simple and safe ammunition management system for firing mixed ammunition types in an automatic cannon, having few moving parts, high ammunition transfer speed and high reliability, in which the risk of fire stoppages is low.

This object, as well as other objectives not enumerated here, is satisfactorily met within the scope of that which is described herein.

Thus, according to the present invention, a simple and safe ammunition management system for firing mixed ammunition types in an automatic cannon, having few moving parts and comprising a rotatable ammunition magazine and an ammunition feed device, has been provided.

What can principally be considered characteristic is that the ammunition management system comprises a drive device for driving the ammunition magazine via a chain drive mechanism disposed in the ammunition magazine, and that the ammunition management system comprises a decoupling device for engagement and disengagement of the ammunition magazine with respect to the ammunition feed device, so that ammunition can be moved between different positions in the ammunition magazine, via an alternating process comprising: feeding of ammunition from the ammunition magazine to the ammunition feed device, disengagement of the ammunition magazine, rotation of the ammunition magazine, engagement of the ammunition magazine, and feedback of ammunition from the ammunition feed device to the ammunition magazine.

According to further aspects of the automatic ammunition management system according to the invention:

the ammunition magazine is rotatably disposed on the bottom side of the breech casing in the vertical direction via two front rotation shafts and two rear bolts, and via two handles, one on either side of the ammunition magazine, with which the ammunition magazine can easily be lowered from a tilted-up position into a tilted-down position during servicing or during emptying of the magazine, the ammunition magazine is driven via at least two separate chains, which are synchronized with one another via a system of drive shafts and chain wheels, which distribute the drive force between the chains and ensure that the chains are always synchronized with one another, the chains are manually adjustable via a chain-adjusting mechanism, comprising adjusting screws connected to raisable and lowerable chain holders on the end walls, arranged such that, when a chain holder is adjusted upwards in the height direction, pretension in the chain increases and, when a chain holder is adjusted downwards in the height direction, the pretension decreases, the ammunition magazine comprises a hatch for manual feed-in and feed-out of ammunition to the ammunition magazine, the ammunition magazine comprises an external angle encoder, configured to verify the position of the ammunition in the ammunition magazine, wherein the angle encoder is mounted on one of the drive shafts of the ammunition magazine via a flexible damping device in order to minimize the effect of harmful shocks or vibrations, the ammunition magazine is connected to the ammunition feed device via a coupling shaft configured with square cross section, which makes it impossible to connect the magazine to the ammunition feed device incorrectly.

According to the present invention, a method for sorting mixed ammunition types in an ammunition management system, comprising a rotatable ammunition magazine, an ammunition feed device, a breech casing and a decoupling device for decoupling the ammunition feed device from the ammunition magazine, has also been provided.

What can principally be considered characteristic of the method is that the method comprises the following stages: feeding of ammunition from the ammunition magazine to the ammunition feed device; decoupling of the ammunition magazine from the ammunition feed device via the decoupling device; rotation of the ammunition magazine into a new position; coupling of the ammunition magazine with the ammunition feed device, and feeding of ammunition from the ammunition feed device into the new position in the ammunition magazine, whereafter the said stages are repeated until the ammunition is ready-sorted.

As a result of that which has been proposed above, an advantageous ammunition management system which means a simplified ammunition sorting of mixed ammunition types in an automatic cannon is obtained.

The invention means that the ammunition management system can choose between several different sorting programs. The software of the gun keeps track of different ammunition types and their placement in the ammunition magazine. No manual sorting is required. The invention solves the drawbacks which arise where a plurality of ammunition magazines are used in the sorting of different ammunition types. The use of just one ammunition magazine offers the advantages, above all, of a more lightweight product which is simpler, faster and has greater reliability.

BRIEF DESCRIPTION OF THE DRAWINGS

A currently proposed embodiment of an ammunition management system which has the characteristics significative of the invention is described below with simultaneous reference to the appended drawings, in which.

DETAILED DESCRIPTION

Figure 1:
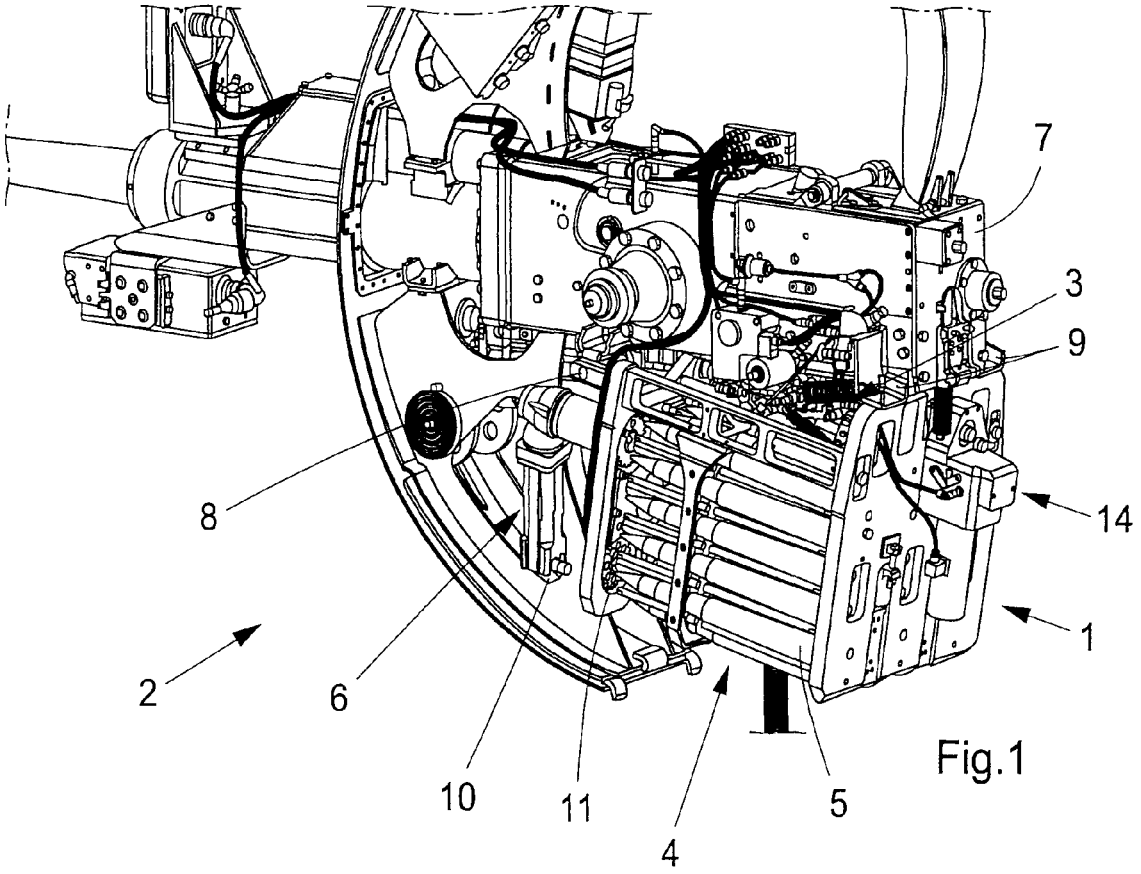
FIG. 1 shows an ammunition management system according to invention, mounted in an automatic cannon.

FIG. 1 shows an ammunition management system 1 according to the invention, disposed in an automatic cannon 2. The ammunition management system comprises an ammunition feed mechanism 3, also referred to as an ammunition feed device, and a rotatable ammunition magazine 4 comprising ammunition 5, also referred to as ammunition shot or ammunition unit, wherein the ammunition magazine 4 and ammunition feed mechanism 3 are driven by a common drive device 6.

The ammunition magazine 4 is rotatably and detachably arranged directly on the breech casing 7 of the automatic cannon 2, below the ammunition feed mechanism 3, via two front rotation shafts 8 and two rear bolts 9. In the rotatable ammunition magazine 4 there is arranged 10-50 ammunition shots 5, preferably 15 ammunition shots 5, ready to be fired from the automatic cannon 2. When the automatic cannon 2 is ready to fire, ammunition units 5 are fed from the ammunition magazine 4 to the breech casing 7 via the ammunition feed device 3.

Figure 2:
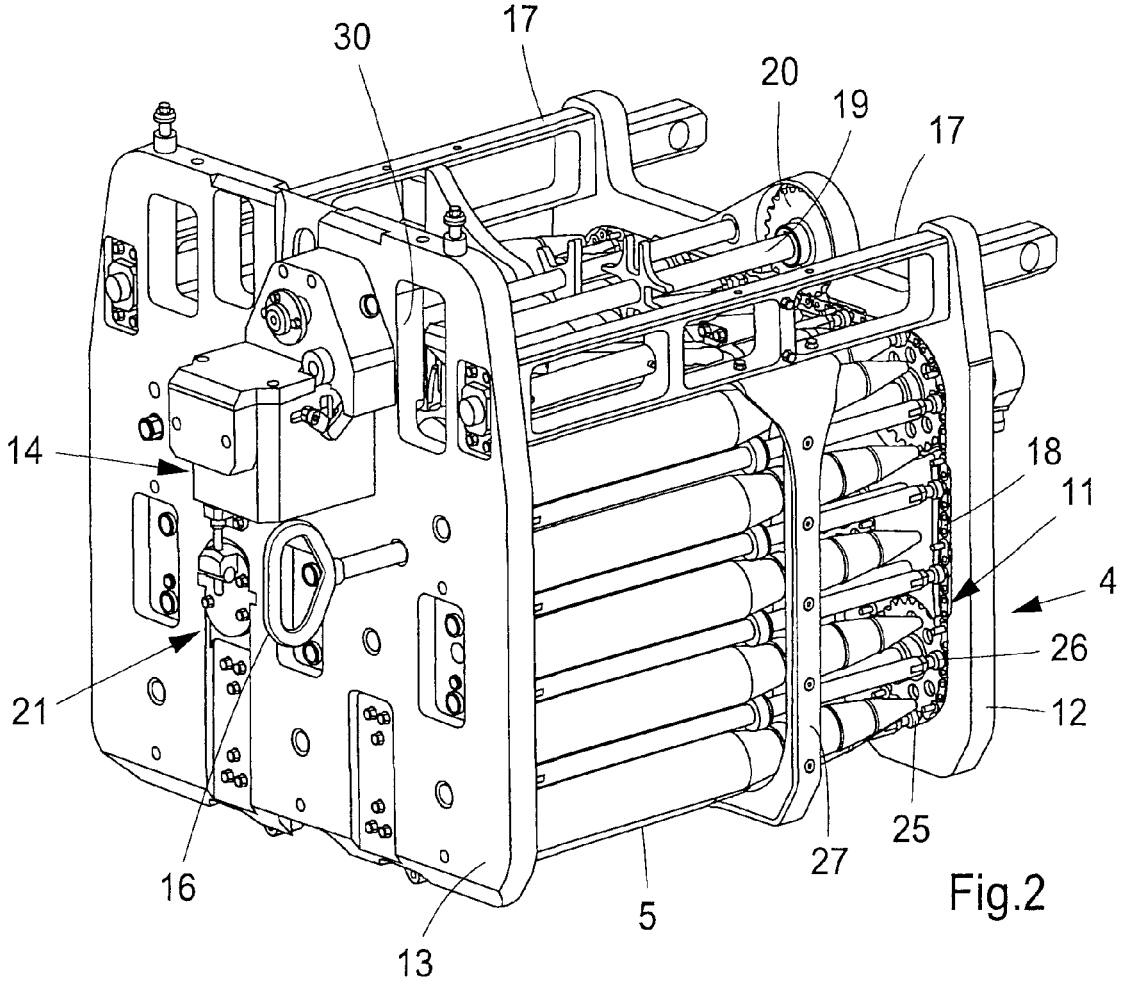
FIG. 2 shows the ammunition magazine according to FIG. 1, viewed obliquely from the rear.

The drive device 6 comprises an electric motor 10 for driving the ammunition magazine 4 and the ammunition feed mechanism 3 via a chain drive mechanism 11 disposed in the front and rear end walls 12, 13 of the ammunition magazine 4, FIG. 2.

The ammunition management system 1 is arranged such that, when the ammunition magazine 4 rotates anti-clockwise (viewed from the rear from the rear end wall 13), ammunition is fed from the ammunition magazine 4 to the breech casing 7 of the cannon. Clockwise rotation of the ammunition magazine 4 is used for emptying of ammunition 5 and in the sorting of mixed ammunition 5 in the ammunition magazine 4. Adjacent to the chain drive mechanism 11 and the ammunition feed mechanism 3 there is arranged a disengaging device 14, configured as a claw coupling, which makes it possible to rotate the ammunition magazine 4 even when the ammunition feed device 3 is stationary. By alternating between anti-clockwise and clockwise rotation of the ammunition magazine 4, corresponding to feed-in/feed-out of ammunition 5 to/from the ammunition feed device 3, it is possible to sort the ammunition 5 in the ammunition magazine 4 according to a preselected sorting program.

The ammunition management system 1 comprises, apart from the ammunition magazine 4, the feed mechanism 3, the chain drive mechanism 11 and the disengaging device 14, as well as an angle encoder 15 for registering the relative position of the ammunition 5 in the ammunition magazine 4.

The ammunition magazine 4 is accessible in a simple and manageable manner, for example in connection with servicing or when the ammunition magazine 4 needs to be emptied quickly, via two rear, releasable bolts 9 and two handles 15, one on either side of the ammunition magazine 4, with which the ammunition magazine 4 can be lowered from a tilted-up position into a tilted-down position.

On the top side of the ammunition magazine 4 there is arranged a protruding locking shaft coupled to a cardan joint, which has to be released before the ammunition magazine 4 can be lowered.

The ammunition magazine 4 with ammunition 5, chain drive mechanism 11 and end walls 12, 13 is held together by two beams 17, mounted between the end walls 12, 13, and a centre bracket 27 fitted to the beams 17. End walls 12, 13 and the beams 17 are preferably made of aluminium or steel.

Figure 3:
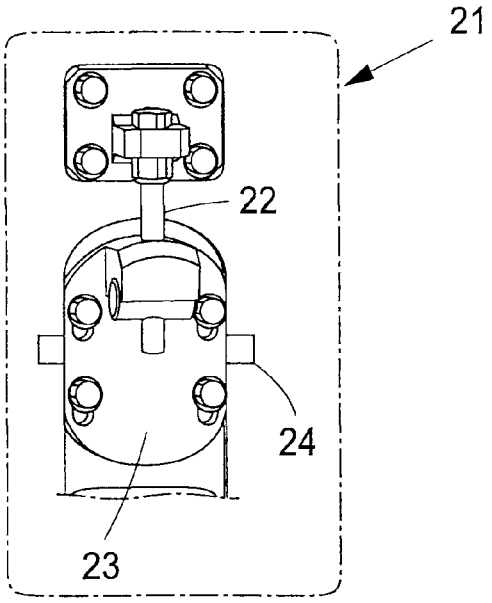
FIG. 3 shows an enlargement of the ammunition-adjusting mechanism according to FIG. 2.

The ammunition magazine 4 is driven by the chain drive mechanism 11 via two separate chains 18 disposed in the front end wall 12 and in the rear end wall 13 respectively. The chains 18 are synchronized with one another via a number of drive shafts 19, which distribute the drive force from the electric motor 10 to the chains 18. In total, six drive shafts 19 and six chain wheels 20 are used, which ensures that the chains 18 are always synchronized with one another, even if one of the chains 18 is loose. There is also the possibility of adjusting the chains 18 manually via a chain-adjusting mechanism 21. The adjustment is made with the aid of adjusting screws 22 connected to raisable and lowerable chain holders 23 on the end walls 12, 13. When a chain holder 23 is adjusted upwards in the height direction, pretension in the chain 18 increases, and when a chain holder 23 is adjusted downwards in the height direction, the pretension decreases, FIG. 3. The degree of pretension is monitored via graduated scales 24, arranged adjacent to a chain holder 23.

The ammunition 5 is transported around in the ammunition magazine 4 via/on guide rods 25, which are coupled to the chain drive mechanism 11 via mounting pins 26.

Figure 4:
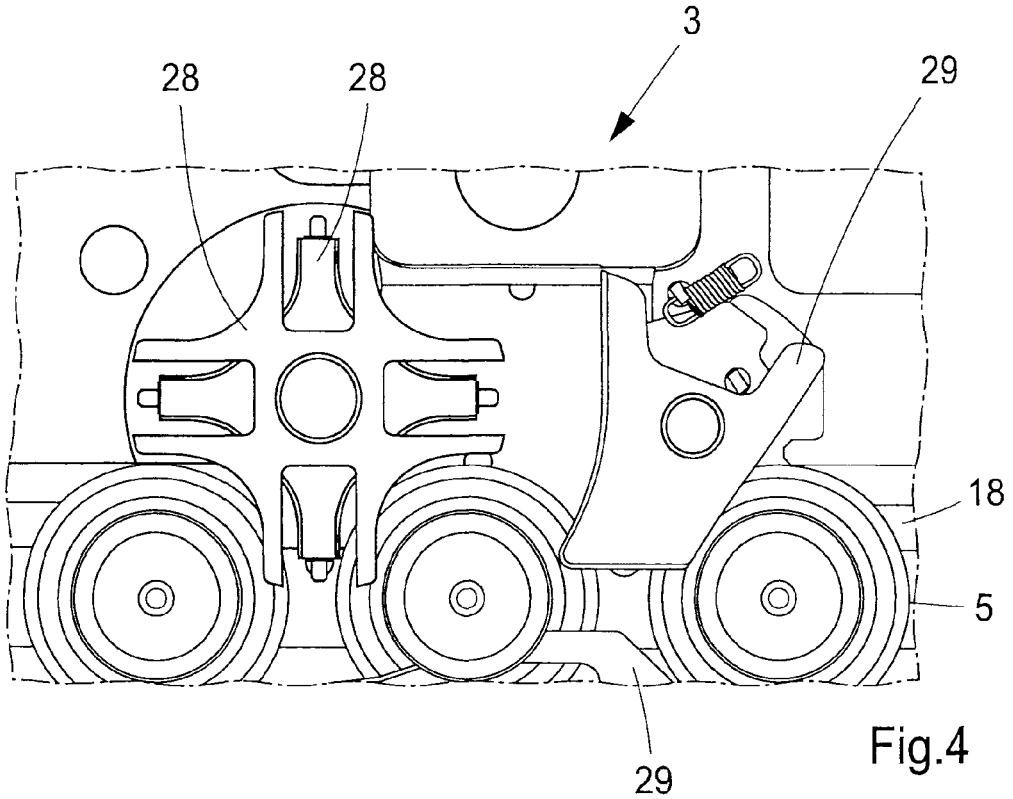
FIG. 4 shows the relative positions of the star wheels and pawls, disposed in the ammunition management system, in the chain feed mechanism when ammunition is fed from the magazine to the breech casing of the cannon.
Figure 5:
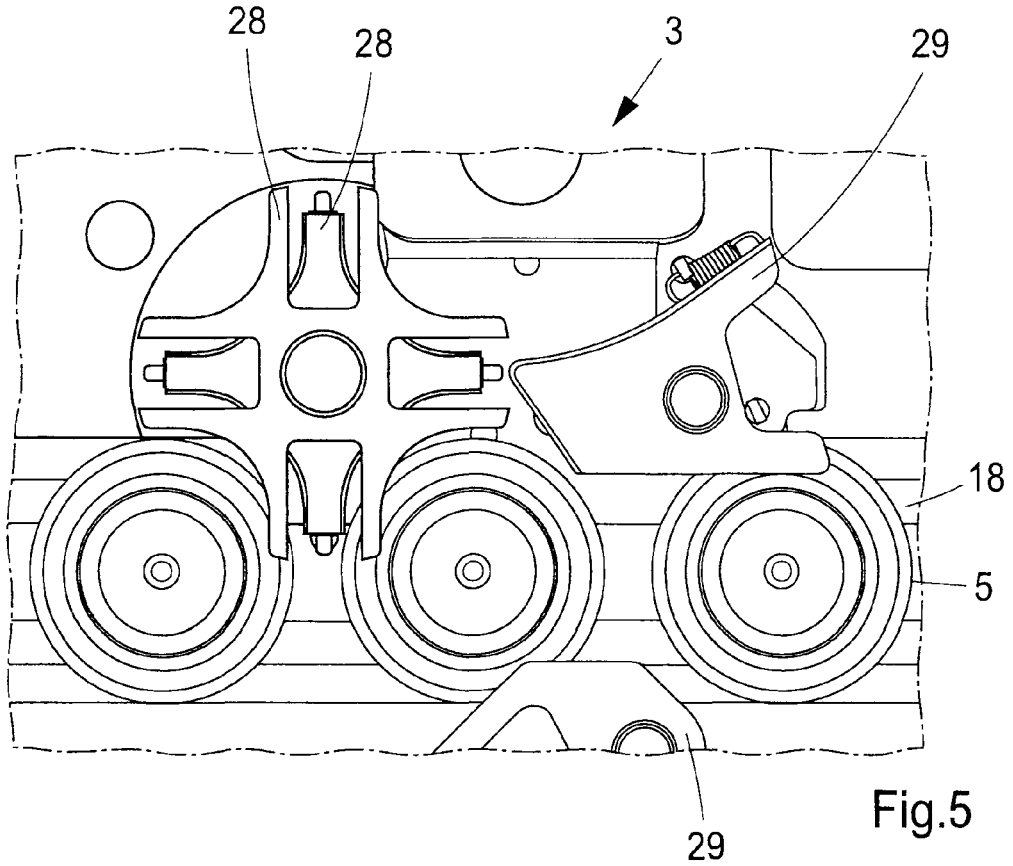
FIG. 5 shows the relative positions of the star wheels and pawls, disposed in the ammunition management system, in the chain feed mechanism when ammunition is fed from the breech casing of the cannon to the magazine.

The star wheels 28, FIG. 4, are mechanically synchronized with the chains 18 and will always correspond with the space (distance) between the ammunition 5. The primary task of the star wheels 28 is to feed ammunition 7 to and from the ammunition feed device 3 via spring-loaded pawls 29, FIG. 4 and FIG. 5 respectively. When the ammunition 5 is fed to the breech casing 7 of the cannon, the chains 18 rotate clockwise. The star wheels 28 press the ammunition 5 against the spring-loaded pawls 29, which guide ammunition 5 out from the ammunition magazine 4 and onwards into the ammunition feed device 3, FIG. 4.

Figure 10:
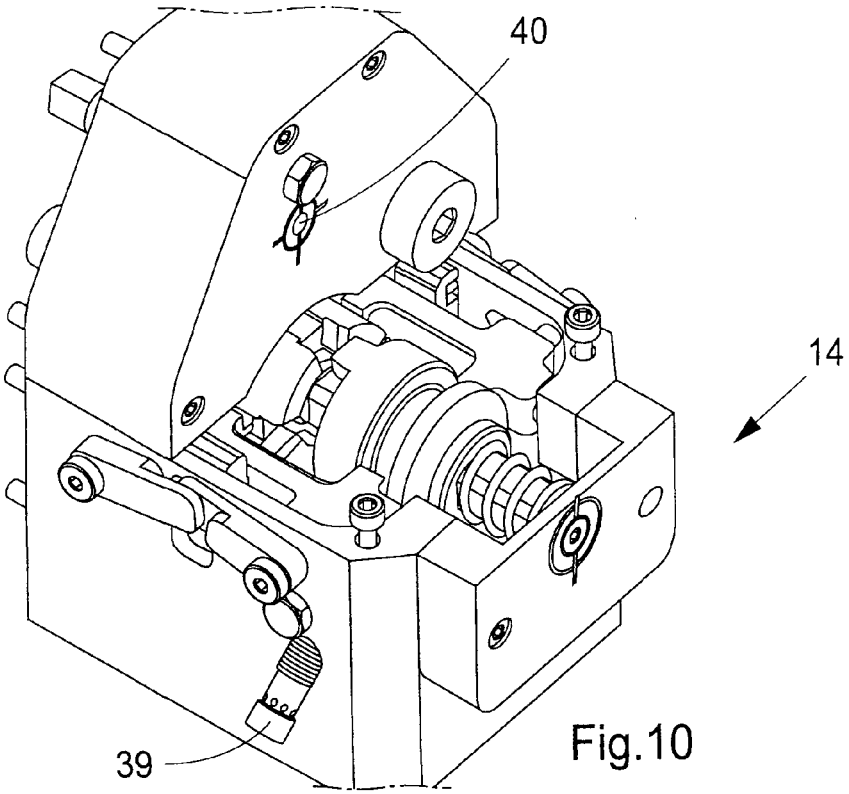
FIG. 10 shows the decoupling mechanism according to FIG. 9 in the activated state.

When the ammunition 5 moves in the opposite direction, anti-clockwise, in the ammunition magazine 4, the spring-loaded pawls 29 will be opened when the ammunition 5 presses on the pawls 29, while the ammunition 5, if there is any ammunition 5 in the feed-in position of the ammunition feed device 3, can be fed back to a vacant position in the ammunition magazine 4 unless the decoupling device 14 is activated and prevents disengagement, FIG. 10.

Figure 6A:
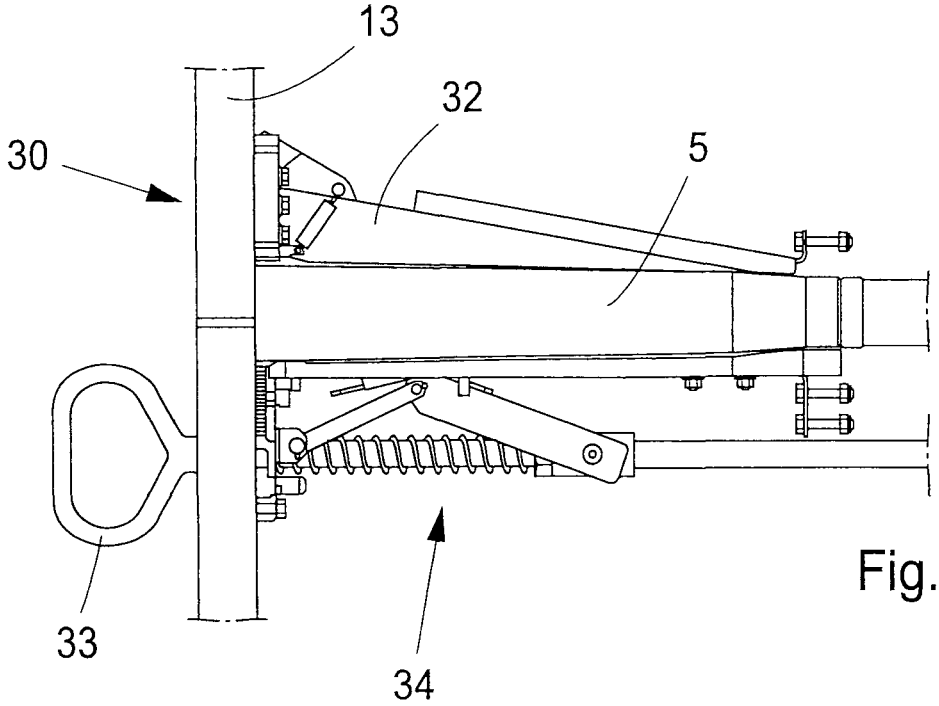
FIG. 6*a* shows an ammunition feed device, disposed in the ammunition management system, for manual feed-in and feed-out of ammunition to and from the magazine, wherein the said ammunition is shown in fed-in position in the magazine.
Figure 6B:
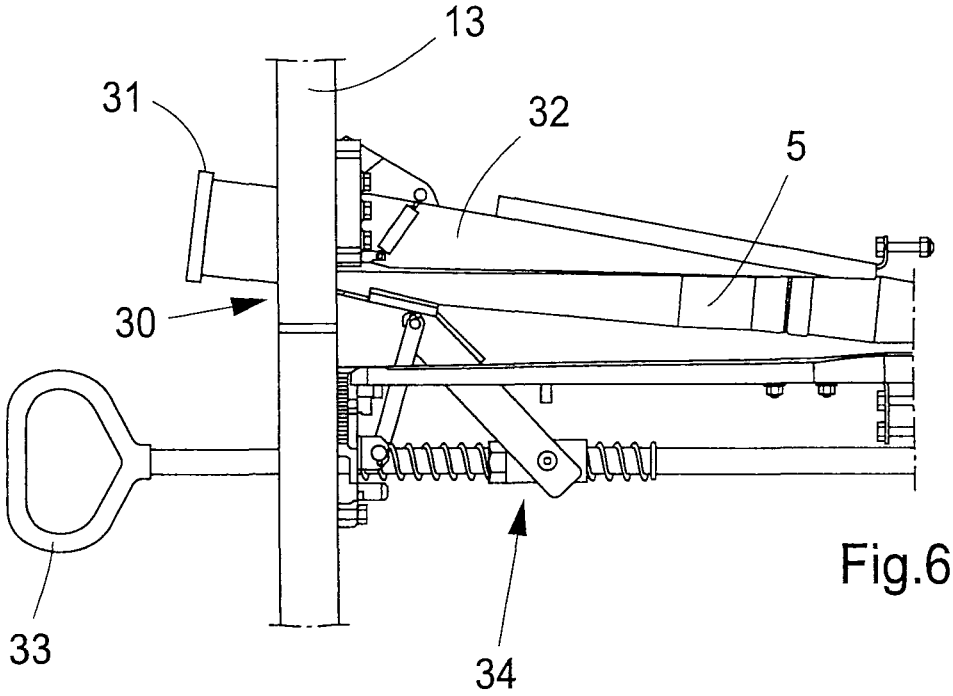
FIG. 6*b* shows the ammunition feed device according to FIG. 6*a*, wherein the ammunition is shown in fed-out position in the magazine.
Figure 7:
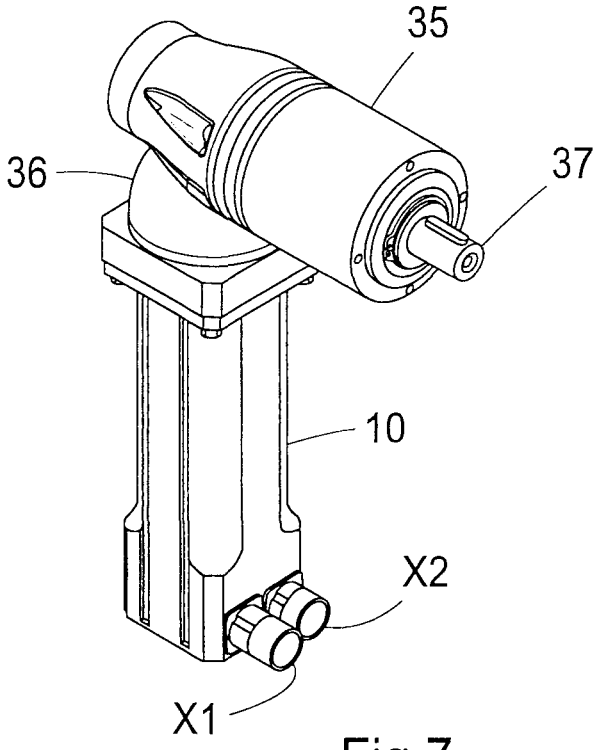
FIG. 7 shows a drive device, disposed in the ammunition management system, for driving the magazine.
Figure 8:
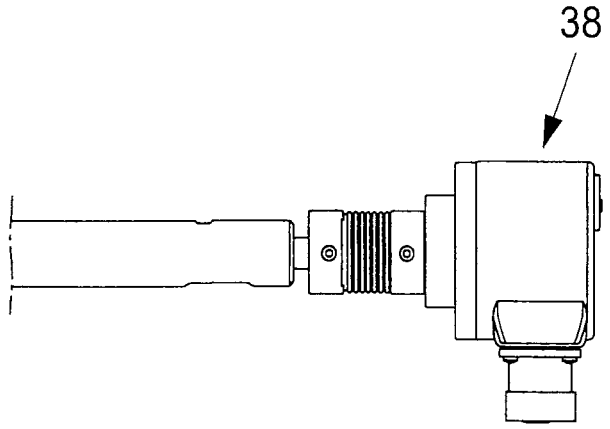
FIG. 8 shows an external angle encoder for monitoring the placement of the ammunition in the magazine.

In the upper right-hand corner of the rear end wall 13 there is a hatch 30 intended for manual loading/unloading of ammunition 5 to/from the ammunition magazine 4. In the case of loading, ammunition 5 is introduced into the ammunition magazine 4 via the hatch 30 into a position in which the flange 31 of the ammunition casing meets a stop in the end wall 13, whereafter the ammunition unit 5 is pressed down into its intended position with the aid of a spring-loaded hook 32. By pulling on a black handle 33 on the end wall 13, a spring-loaded ejection mechanism 34 is activated, which ejects the ammunition 5, FIGS. 6*a* and 6*b*.

The ammunition magazine 4 and the ammunition feed device 3 are driven by a drive unit comprising a planetary gear, a servomotor 10 having a built-in absolute angle encoder (internal angle encoder), and a mechanical brake.

The internal encoder in the servomotor 10 is used to monitor the ammunition magazine 4. If a power cut occurs, the mechanical brake will be activated, whereupon the ammunition magazine 4 comes to a halt and is locked. It is nevertheless still possible to release the brake on condition that the power system is engaged, the magazine 4 being manually rotatable with the aid of a hand-operated crankshaft.

The drive device 6 comprises an electric motor 10 for driving the ammunition magazine 4 and the ammunition feed mechanism 3 via a chain drive mechanism 11 disposed in the front and rear end walls 12, 13 of the ammunition magazine 4. The chain mechanism 11 is driven via a front drive shaft 37 on the front end wall 12. To the front drive shaft 37 is also fitted a planetary gear 35, to which the drive shaft of the electric motor 10 is connected via a fixed hub 36. The hub 36 is mounted with a hexagon socket head screw, which is accessible via the mounting plate. The motor 10 has two connections, an X1 connection for mains supply and an X2 connection for signal.

An external angle encoder 38 is positioned on the front end wall 12 of the ammunition magazine 4, in which it is mounted on one of the drive shafts via a flexible damping device in order to minimize the effect of harmful shocks or vibrations. The external encoder 38 is used only to verify that position of the ammunition 5 which is given by the internal encoder in the servomotor 10.

In loading and unloading of ammunition 5 to the ammunition feed mechanism 3 from the ammunition magazine 4, the movement of the ammunition magazine 4 is synchronized with the star wheel 28 in the chain drive mechanism 11 via three gearwheels in the decoupling device 14. In the stated case, the decoupling device 14 is always deactivated.

In order to enable reorganization and shifting of ammunition 5 between different ammunition types 5 in the ammunition magazine 4, the ammunition feed device 3 must be able to be decoupled from the ammunition magazine 4, i.e. the decoupling device 14 must be activated, which is done with the aid of a solenoid, which controls the decoupling device 14.

The decoupling device 14 comprises a rear movable claw, which is activated once the solenoid has pressed back the claw into its rear position. In the event of a power cut, the decoupling device 14 will remain deactivated due to preloaded helical springs which act on the disengaging device 14 such that the movable claw of the decoupling device 14 is kept pressed back in its rear position. An inductive sensor 39, FIG. 9, directed towards the flange of the movable claw, signals when the claw changes position, i.e. when the decoupling device 14 is activated.

Figure 9:
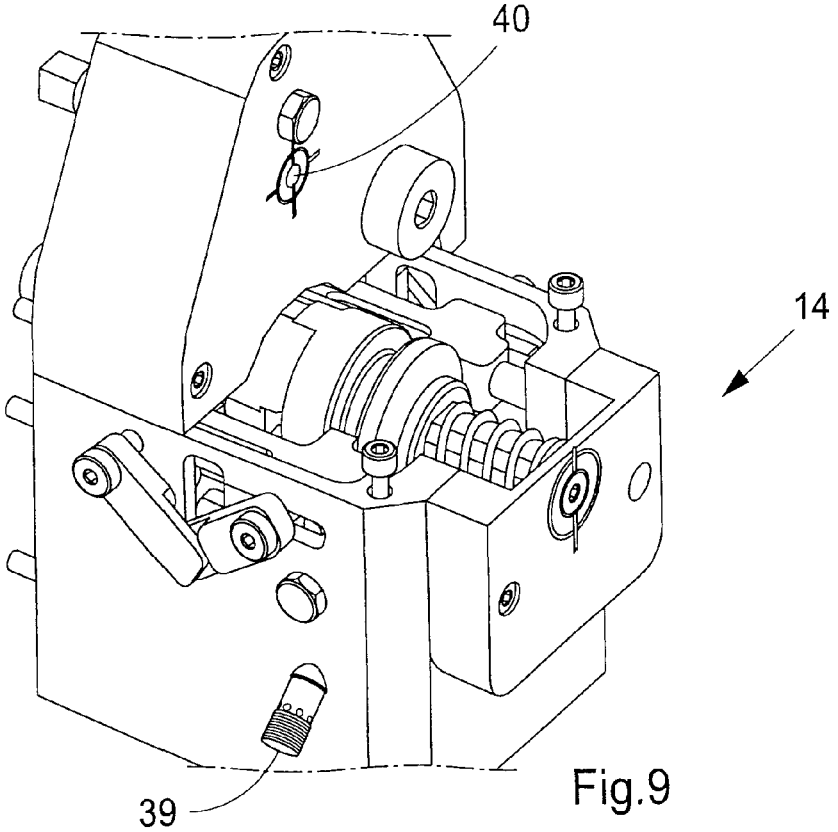
FIG. 9 shows a decoupling mechanism, disposed in the ammunition management system, for decoupling the magazine from the ammunition feed device in the resorting of ammunition, wherein the decoupling mechanism is shown in the deactivated state.

The ammunition magazine 4 is connected to the ammunition feed device 3 via a coupling shaft 40, FIG. 9, configured with square cross section, which makes it impossible to connect the magazine 4 to the ammunition feed device 3 incorrectly. In order to remove or lower the ammunition magazine 4, the ammunition magazine 4 must be decoupled from the ammunition feed device 3. The decoupling can be realized by connecting an M8-screw to the coupling shaft 40 and subsequently pulling on the coupling shaft 40 such that it comes loose from the cardan joint in the ammunition feed device 3.

The invention claimed is:

1. An ammunition management system, comprising:

a rotatable ammunition magazine comprising ammunition, a breech casing, an ammunition feed device configured to provide mixed ammunition to an automatic cannon, a drive device configured to drive the ammunition magazine via a chain drive mechanism disposed in the ammunition magazine, and a decoupling device configured to engage and disengage the ammunition magazine with respect to the ammunition feed device, so that ammunition is movable between different positions in the ammunition magazine, via an alternating process comprising: feeding of ammunition from the ammunition magazine to the ammunition feed device, disengagement of the ammunition magazine, rotation of the ammunition magazine, engagement of the ammunition magazine, and feedback of ammunition from the ammunition feed device to the ammunition magazine.

2. The ammunition management system according to claim 1, wherein the ammunition magazine is rotatably disposed on a bottom side of the breech casing in a vertical direction via two front rotation shafts and two rear bolts, and via two handles, one on either side of the ammunition magazine, with which the ammunition magazine can be lowered from a tilted-up position into a tilted-down position during servicing or during emptying of the magazine.

3. The ammunition management system according to claim 1, further comprising:

at least two separate chains configured to drive the ammunition magazine, a system of drive shafts and chain wheels configured to synchronize the at least two chains with one another, wherein the drive shafts and chain wheels distribute a drive force between the at least two chains and ensure that the at least two chains are always synchronized with one another.

4. The ammunition management system according to claim 3, further comprising:

a chain-adjusting mechanism configured to manually adjust the at least two chains, the chain-adjusting mechanism comprising adjusting screws connected to raisable and lowerable chain holders on end walls arranged such that, when a chain holder is adjusted upwards in a height direction, pretension in the chain increases and, when a chain holder is adjusted downwards in the height direction, the pretension decreases.

5. The ammunition management system according to claim 1, wherein the ammunition magazine comprises a hatch for manual feed-in and feed-out of ammunition to the ammunition magazine.

6. The ammunition management system according to claim 1, wherein the ammunition magazine comprises an external angle encoder configured to verify a position of the ammunition in the ammunition magazine, wherein the angle encoder is mounted on one of drive shafts of the ammunition magazine via a flexible damping device in order to minimize an effect of shocks or vibrations.

7. The ammunition management system according to claim 1, further comprising:

a coupling shaft configured to connect the ammunition magazine to the ammunition feed device, the coupling shaft having a square cross section, thereby ensuring that the magazine is correctly connected to the ammunition feed device.

8. A method for sorting mixed ammunition in an ammunition management system, comprising a rotatable ammunition magazine, an ammunition feed device, a breech casing and a decoupling device for decoupling the ammunition feed device from the ammunition magazine, the method comprising:

feeding of ammunition from the ammunition magazine to the ammunition feed device;

decoupling of the ammunition magazine from the ammunition feed device via the decoupling device;

rotation of the ammunition magazine into a new position;

coupling of the ammunition magazine with the ammunition feed device, and feeding of ammunition from the ammunition feed device into the new position in the ammunition magazine, repeating the feeding, decoupling, rotation, coupling and feeding until all the ammunition has been sorted into its predetermined positions.

* * * * *